US005910005A

United States Patent [19]

Scherr

[11] Patent Number: 5,910,005

[45] Date of Patent: Jun. 8, 1999

[54] CANDLEFORMING METHOD

[76] Inventor: Mark J. Scherr, 14720 W. Honey La., New Berlin, Wis. 53151

[21] Appl. No.: 08/814,200

[22] Filed: Mar. 10, 1997

Related U.S. Application Data

[60] Provisional application No. 60/014,663, Apr. 4, 1996.

[51] Int. Cl.[6] ..... C11C 5/00

[52] U.S. Cl. ..... 431/126; 431/288

[58] Field of Search ..... 475/269; 431/253, 431/290, 288, 289, 126; D26/9; 44/275; 435/117; 264/271.1; 427/442

[56] References Cited

U.S. PATENT DOCUMENTS

| | | | |
|---|---|---|---|
| 1,474,890 | 11/1923 | Brinker et al. . | |
| 1,622,347 | 3/1927 | Rhoads . | |
| 3,719,625 | 3/1973 | Parker | 260/28.5 AV |
| 3,759,478 | 9/1973 | Schmitt et al. | 249/93 |
| 3,867,501 | 2/1975 | Powers et al. | 264/219 |
| 4,003,142 | 1/1977 | Morrison et al. | 35/26 |
| 4,004,985 | 1/1977 | Ghany | 249/205 |
| 4,077,110 | 3/1978 | Reiher | 29/458 |
| 5,374,190 | 12/1994 | Brokaw et al. | 434/82 |

OTHER PUBLICATIONS

"Wal–Mart nnounces Global Expansion Plans for 1998," http://www.wal–mart.con/newsroom/global expansion.html; visited on Aug. 13, 1998.

"1998 Year–end Earnings Fact Sheet," http://www/wal–mart.com/newsroom/98factsheet.html; visited on Aug. 13, 1998.

Yaley, T "Easy to Do Dip 'N' Carve Candles" Instruction Booklet, 1974.

Fisher Scientific Catalog, pp. 145, 305, and 683–685, 1983.

Northern Lights, "The Art of Candlemaking", 1995.

Northern Lights Catalog (one page), 1993.

*Primary Examiner*—Scott W. Houtteman
*Attorney, Agent, or Firm*—Donald J. Ersler

[57] ABSTRACT

A method for forming candles according to the invention includes four basic steps: providing a candle core; heating a working area on the outer surface of the candle core such that the working area is pliable; sculpturing a portion of the working area; and reheating the working area with a readily available household heating implement whenever the working area of the candle falls below a desired temperature. A candle core is comprised of multiple inner layers of distinct color and composition, an outer surface preferably having a pliable temperature range of about 120 to 125° Fahrenheit, and a wick extending from a top end and wound into a loop. Because the pliable temperature range of the candle core is relatively low, the candle core need only to be preheated by submerging it a in hot water bath prior to sculpturing. Additionally, the outer surface of the candle core may be reheated anytime during sculpturing using a hair dryer or other readily available household heating source. To facilitate the sculpturing and reheating steps, a sculpturing stand is provided from which the candle core may be suspended by engaging the wick loop with a hook on an elevated member of the sculpturing stand.

16 Claims, 4 Drawing Sheets

CANDLEFORMING METHOD

This application claims the benefit of prior Provisional Patent Application Ser. No. 60/014,663 filed on Apr. 4, 1996.

FIELD OF THE INVENTION

The present invention relates generally to decorative candle products. More particularly, the present invention relates to a method and kit for forming decorative candle products.

BACKGROUND OF THE INVENTION

Decorative candle products are popular items for the home and other displays. These candles may be purchased in a variety of colors, shapes, and designs. Some of the more popular varieties are the ribbon candle, the basket weave candle, and the cutaway candle. Each of these candle designs feature a candle core having an outer surface of one color, typically white, and a plurality of internal layers of different colors. When the outer surface is carved or cut, the multi-color inner layers are exposed and incorporated into the candle design. Finished candles of these types and other types may be found in most craft stores or the craft section of most department stores.

The art of candlemaking, or chandlery as it is sometimes called, has been practiced for centuries by expert candlemakers for leisure and also for sale. Today, expert decorative candlemaking may be observed first hand at an artisan fair or craft event that features a chandler's booth. At the chandler's booth, one might find a candlemaker masterfully create a decorative candle of a complex design in just a few minutes. To obtain a desired color ensemble of inner layers, the candlemaker takes a candle core of one color and dips it repeatedly into a number of heated vats containing melted wax. Then, with the candle core still hot, the chandler skillfully but quickly carves, cuts, and shapes the multi-layered candle core to produce a decorative candle product that the lay person can purchase and take home.

Alternatively, a novice candlemaker may purchase the same candle cores, waxes, vats, and other candlemaking accessories that the candlemaker uses at the chandler's booth and attempt to make his or her own decorative candles at home. A booklet entitled "Easy to Do DIP 'N' CURVE" by Yaley Enterprises (1974) was intended for such a novice candlemaker. The booklet provides basic guidelines to dipping and carving candle cores into fancy decorative candles.

SUMMARY OF THE INVENTION

The present invention is directed to a method for forming decorative candle products. The present invention is also directed to a candleforming kit, a candle core, and a sculpturing stand, each adaptable for use with the candleforming method.

A method for forming candles embodying the invention comprises four basic steps: providing a candle core; heating a working area on the outer surface of the candle core such that the working area is pliable; sculpturing a portion of the working area; and reheating the working area with a readily available household heating implement whenever the working area of the candle core falls below a desired temperature.

One feature of the candle core is that it is already formed with a plurality of internal layers of varying colors and composition. Therefore, the candleforming method does not require the novice candlemaker to prepare vats of melted waxes and dip candles cores in the vats prior to sculpturing.

The candle core need only to be preheated with hot water or another heated fluid in preparation for the sculpturing step. Another feature of the candle core is that it is made from a blend of waxes and resins such that its outer surface is pliable below a temperature of about 130° Fahrenheit. Consequently, the candle core may be preheated using only hot water from a kitchen tap or some other common low heat capacity household resource. Furthermore, the candle core may be reheated during the sculpturing step using a readily available heating implement such as a hair dryer rather than a butane torch, propane torch, or some other open flame or high heat source. As a result, the sculpturing step is not very time restrictive and the novice candleformer does not have to work at a frantic pace.

The purpose of preheating the candle core is to make the outer surface of the candle core sufficiently pliable for sculpturing. First, a water bath preferably having a temperature between about 120° and 125° Fahrenheit is prepared. Next, the candle core and some of the heated water from the water bath are transferred into a closeable preheat container and sealed. Then, the sealed preheat container with the candle core is submerged in the water bath for a duration of about 15 to 20 minutes. This method of preheating insures complete and substantially uniform heat distribution throughout the candle core, thereby facilitating the sculpturing process. A temperature indicator customized to indicate the pliable temperature range of the candle core is provided with the candleforming kit. This temperature indicator may be used in preparing the water bath and in monitoring the water bath temperature during the preheating step.

After the candle core is removed from the water bath, it is placed in a position for sculpturing. Preferably, the candle core is suspended by its wick loop from the sculpturing stand. The sculpturing stand includes an elevated member and a suspending implement, such as a hook, affixed to the elevated member. The candle core may be suspended by engaging the wick loop with the suspending implement. When suspended in this fashion, the candle core is easily accessible and maneuverable, and thus, the sculpturing process is facilitated. The candle core may also be reheated while it is suspended from the sculpturing stand.

The candleforming kit also includes an instruction booklet with a step-by-step guide and illustrations on how to sculpture a variety of design patterns on the outer surface of the candle core. Prior to a sculpturing step, a portion of the guide may be placed adjacent to the outer surface of the candle core and serve as a design template. Using the template, a pattern on the guide is etched on the outer surface. The etched pattern then serves as an outline for cutting, carving, or otherwise sculpturing a specific design on the candle core. Alternatively, the guide may include a scale with hash marks. The scale may be placed adjacent to and aligned with the candle core so that the outer surface is marked according to the hash marks. The marks serve as a guide for positioning various cuts or carves on the outer surface in accordance with a specific design or pattern.

In an alternative embodiment of the invention, the candleforming method includes a first and a second candle core. A first candle core is sculptured in accordance with the candleforming method; but, the sculptured portions are removed from the first candle core and deposited on the second candle core.

Alternatively, portions of the first candle core may be simply removed and deposited on the second candle core where it is then sculptured. The second candle core is ultimately transformed into a finished decorative candle product. In yet another embodiment, the candleforming kit incudes distinct decorative items and other articles that may be placed on a preheated candle core using a holding implement such as tweezers, and a common hair dryer.

It is a feature and an advantage of the present invention to provide a candleforming kit and method for producing decorative candles at home.

It is a feature and an advantage of the invention to provide a candleforming kit and method for forming decorative candles of various shapes, colors, and designs.

It is a feature and an advantage of the invention to provide a candleforming method that utilizes materials and resources readily found in the ordinary household.

It is a feature and an advantage of the invention to provide a candleforming kit that is relatively inexpensive.

It is a feature and an advantage of the present invention to provide a candleforming kit and method that are easy to employ.

It is a feature and an advantage of the present invention to provide a candleforming method that is not labor intensive nor time restrictive.

It is a feature and an advantage of the present invention to provide a candleforming method that utilizes candle cores requiring little preparation prior to sculpturing.

DETAIL DESCRIPTION OF THE INVENTION

Figure 1:
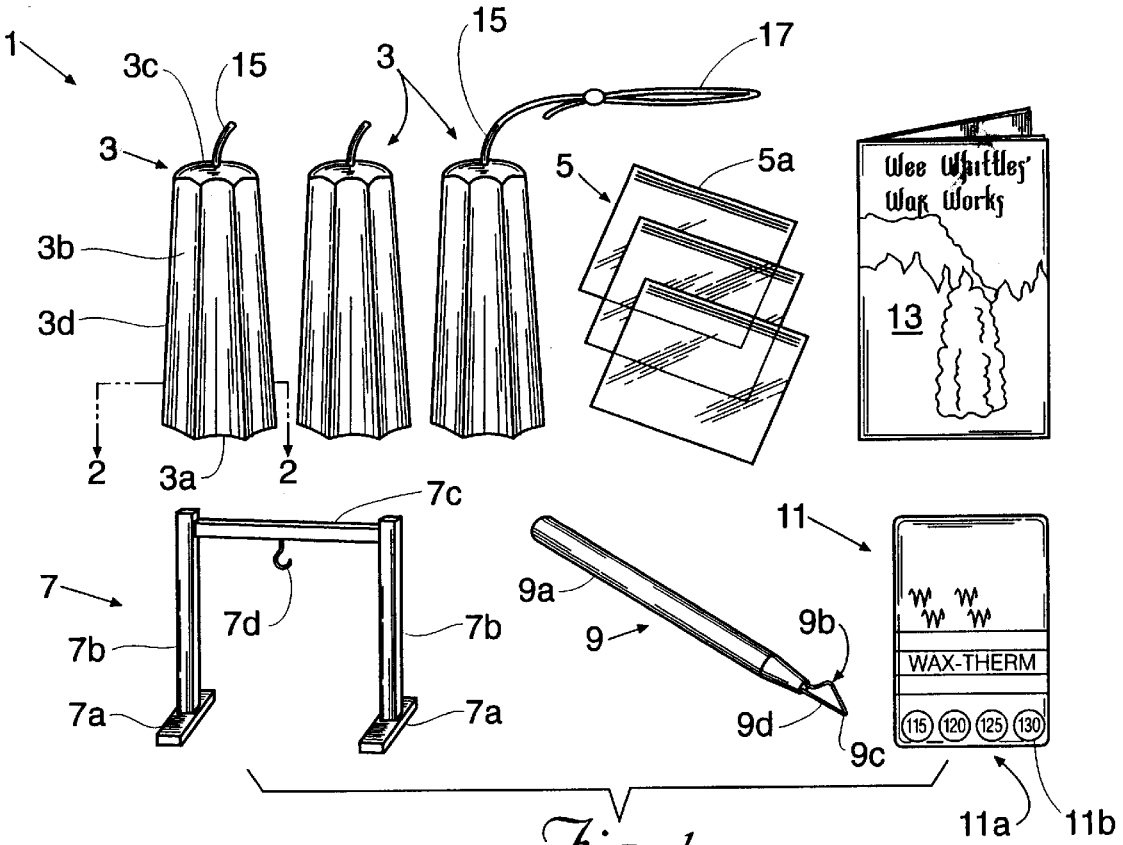
FIG. 1 depicts materials included in a candleforming kit.

FIG. 1 depicts a candleforming kit 1 adaptable for use with a candleforming method of the invention. Candleforming kit 1 includes a plurality of candle cores 3, a plurality of preheat containers 5, a sculpturing stand 7, a sculpturing implement 9, a temperature indicator 11, and an instruction booklet 13.

Figure 2:
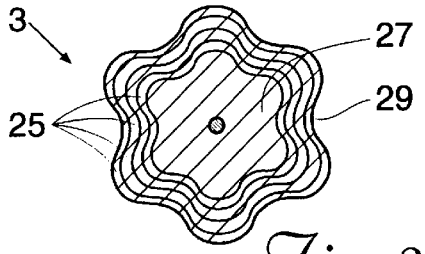
FIG. 2 is a cross sectional top view through line 2—2 in FIG. 1 of a candle core according to the invention.

Candle core 3 includes a body member 3*d* having an enlarged base 3*a*, a plurality of tapered flutes 3*b*, and a reduced top end 3*c*. A wick 15 extends from the center of top end 3*c* and is wound around to make a wick loop 17. Candle core 3 is preferably four to eight inches high. Referring now to FIG. 2, body member 3 of candle core 3 is made up of a plurality of individual layers 25 that are wrapped around a central body portion 27. Each layer 25 may be of a distinct composition and/or color and is pre-applied to central body portion 27. Candle core 3 needs only to be preheated in preparation for sculpturing.

A candle core 3 of certain physical dimensions and characteristics is described and depicted in the drawings. However, it will be apparent to those skilled in the art to employ the present candleforming method to produce decorative candle products from candle cores having a variety of shapes and proportions.

Each candle core 3 is formed from a blend of resins and waxes that produces not only multiple layers 25 of distinct color and/or composition but a candle core 3 having physical properties uniquely adaptable for forming decorative candles at home. Candle core 3 may be formed by a dipping process, a pouring process, or some other known process for producing cores with multiple layers (or without layers). Candle core 3 of the invention is pliable at temperatures below about 130° Fahrenheit and melts at temperatures between about 130° Fahrenheit and 150° Fahrenheit. Preferably, outer surface 29 of candle core 3 will be pliable between about 120° Fahrenheit and 125° Fahrenheit. This relatively low temperature range allows the candleformer to utilize readily available household heating sources in preheating candle core 3 and, also, in reheating outer surface 29 of candle core 3 during sculpturing. Additionally, because the temperature of candle core 3 is relatively low after preheating, the candleformer has the option of working outer surface 29 by hand.

It is advantageous to place candle core 3 in a suspended position during sculpturing, preferably using sculpturing stand 7. Referring again to FIG. 1, sculpturing stand 7 includes a pair of base members 7*a*, a pair of spaced apart post members 7*b*, and an elevated cross member 7*c*. A suspending implement 7*d*, such as a hook 7*d*, is affixed to cross member 7*c*. After preheating, candle core 3 may be suspended from hook 7*d* using wick loop 17.

Referring to FIG. 1, gouge tool 9 has a handle 9*a* and a blade 9*b* that is bent to form a leading tip section 9*c*. Tip section 9*c* is uniquely adaptable to penetrating outer surface 29 of candle core 3 to make a gouge cut. A straight section 9*d* of blade 9*b* may be used to remove unwanted melted wax from outer surface 29 and to finish working areas. There are other sculpturing techniques that may be performed using some other type of sculpturing implement. A common kitchen knife (not shown) will be sufficient for many applications. For example, basic carving techniques may be performed using a non-serrated paring knife while curling and shaping may be performed by hand.

It should be noted that the word "sculpturing", as used herein, refers to a process of making forms or figures out of candle material by carving, cutting, chiseling, hewing, casting, modeling, or otherwise shaping the candle material. Moreover, the sculpturing process may involve the use of a sculpturing implement (e.g., a carving knife or chisel) or may be performed by hand.

Preheat container 5 is preferably a transparent plastic bag with a sealable edge 5*a* and adequate holding capacity to retain a single candle core 3 and some heated water. A common freezer or vegetable bag will suffice in many applications.

Referring again to FIG. 1, temperature indicator 11 is used to monitor the temperature of a water bath in which candle cores 13 are submerged in a preheating step. Temperature indicator 11 is inserted into the water bath container during preparation of the water bath and remains in the water bath through the preheating step. Referring again to FIG. 1, temperature indicator 11 provides an easily viewed color coded means 11*a* for indicating four temperatures relevant to the candleforming method. Color coded means 11*a* includes four individual heat sensitive pads 11*b*. Each of pads 11*b* responds to a trigger temperature by changing from a normal brown color to a bright green color when the water bath temperature nears that temperature. The trigger temperatures are also printed in large, bold blocks on each pad 11*b*. Preferably, the four trigger temperature will be 115° Fahrenheit, 120° Fahrenheit, 125° Fahrenheit, and 130° Fahrenheit. In practice, if the water bath temperature is 115° or below, additional hot water should be added to the water bath. If the water bath temperature is at about 130° Fahrenheit, cold water should be added to lower the water bath temperature; otherwise, candle core 3 may begin to melt. Water bath temperatures at or between about 120° and 125° are the preferred water bath temperatures and are sufficient to make outer surface 29 pliable.

Instruction booklet 13 of the invention provides step-by-step guides on how to sculpture several designs on outer surface 29 of candle core 3. Included in each guide are detailed instructions on how to perform the sculpturing techniques required by the designs. A guide may also include a design template (not shown) corresponding to a particular design or pattern. Prior to sculpturing, the template is aligned with candle core 3 and placed adjacent to the intended working area on outer surface 29. Then, using a sculpturing implement and the template as a guide, the design or pattern is outlined on outer surface 29. The design or pattern is then cut, carved, shaped, or otherwise sculptured using the outline.

For some candle designs, a step-by-step guide may include a scale 31 with hash mark indications 33. Such a scale is depicted beside decorative candles 35, 37, 39 in FIGS. 7 through 9. The height of each vertical scale 31 normally corresponds with the height of candle cores 3 to be formed (the vertical scales in FIGS. 7 through 9 have been enlarged for clarity). Scale 31 is typically printed near a bottom edge 43 of a page (not shown) in instruction booklet 13, or alternatively, provided as a cutout removable from instruction booklet 13.

Figure 7:
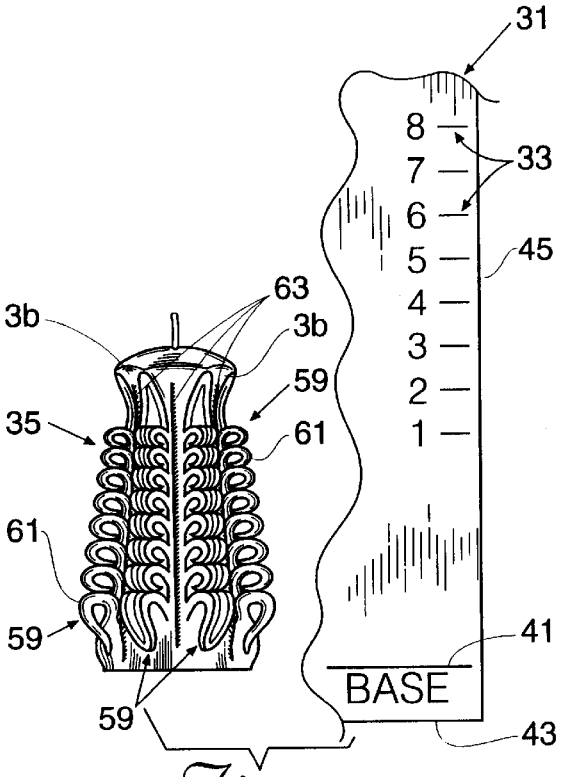
FIG. 7 depicts a ribbon candle placed adjacent to a scale with hash marks according to the invention.

Referring to FIG. 7, scale 31 has a baseline 39 positioned near bottom edge 43. Numbered hash marks 33 begin above baseline 41 and progress vertically therefrom along a vertical edge 45 of the page. When scale 31 is placed adjacent to candle core 3 or a portion of candle core 3 designated as the working area, baseline 41 is aligned with base 3*a* such that hash marks 33 are aligned with outer surface 29 along an imaginary vertical line. Using gouge tool 9 or some other means, vertical positions are etched on outer surface 29 of candle core 3 corresponding to aligned hash marks 33. The vertical marks 33 serve as starting points for individual cuts, carves, and other sculpturing strokes. For other candle designs, a horizontal or circumferential scale as well as a vertical scale may be provided in instruction booklet 13. For decorative candles 35, 37, 39 of FIGS. 7 through 9, the same pattern was sculptured on each of six flutes 3*b* using one vertical scale 31 to identically mark each flute 3*b* before sculpturing.

One feature of the candleforming method is that certain readily available household materials and resources are utilized in the process. For example, because candle core 3 is pliable at a relatively low, safe temperature range, the candleformer may employ a hot water tap as a preheat source and a common hair dryer as a reheating source. As discussed already, some sculpturing techniques may be performed using only the fingers of the hand or with an ordinary kitchen knife or paring knife as the sculpturing implement. In some instances, ordinary utility candles may serve as either a wax source or a base candle. Because candle cores 3 are conveniently sized, a kitchen sink or basin may be used as a water bath container and a freezer bag as a preheat container. By utilizing readily available household items in the candleforming process, the present invention reduces the cost and complexity associated with the candleforming kit and method.

A method for forming candles according to the invention comprises four basic steps: providing a candle core 3; heating a working area on outer surface 29 of candle core 3 such that the working area is pliable; sculpturing a portion of the working area; and reheating the working area with a readily available household heating implement whenever the working area falls below a desired temperature. The working area referred to in the candleforming method may be one portion of outer surface 29 of candle core 3, several portions, or entire outer surface 29.

Candle core 3 used in the candleforming method will have a height, shape, and color composition appropriate for the particular candle design the candleformer desires. Moreover, candle core 3 will preferably have a pliable temperature range of about 120° to 125° Fahrenheit.

Figure 3:
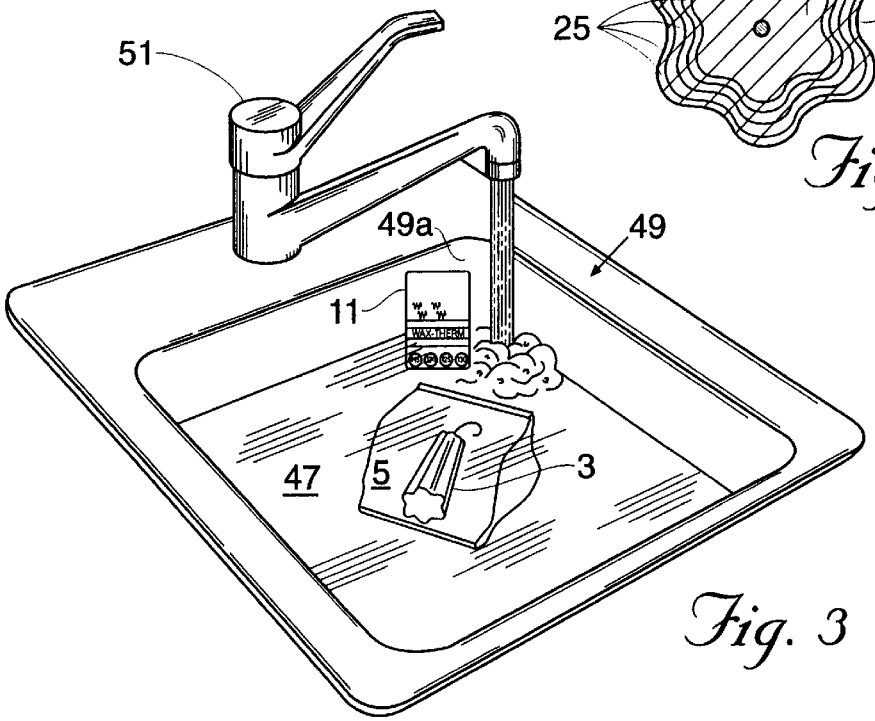
FIG. 3 depicts a preheating step in the candleforming method, wherein the candle core is preheated in a water bath.
Figure 4:
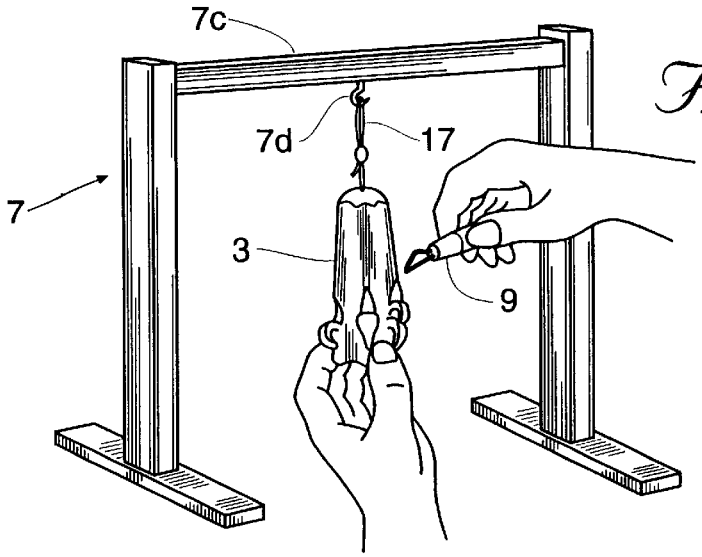
FIG. 4 depicts a sculpturing step in the candleforming method, wherein the candle core is suspended from a sculpturing stand.
Figure 5:
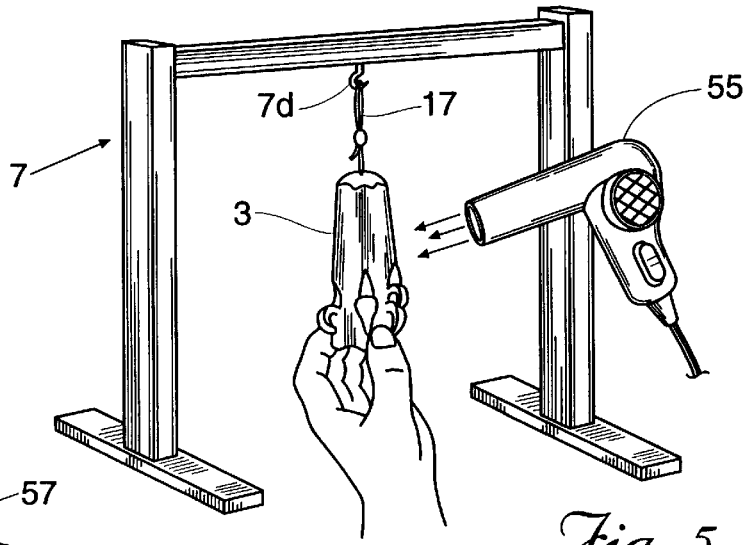
FIG. 5 depicts a reheating step in the candleforming method, the heat being applied by a common hair dryer.

FIGS. 3 through 5 illustrate the remaining steps of the candleforming method. FIG. 3 depicts the preheating step wherein candle core 3 is submerged in a water bath 47 for a required duration. Following instructions provided in instruction booklet 13, the preheating step begins by finding a water bath container that can hold at least one gallon of hot water and candle core 3. As illustrated in FIG. 3, a kitchen sink 49 with a hot and cold water tap 51 provides an adequate water bath setup. Using hot and cold water to regulate the water bath temperature, kitchen sink 49 is filled with a water bath 47 at about 120° to 125° Fahrenheit. As depicted in FIG. 3, temperature indicator 11 may be inserted into water bath 47 and propped against a corner 49*a* to constantly monitor the water temperature throughout the preheating step. In alternative embodiments, a common thermometer (not shown) may be used in lieu of temperature indicator 11. However, temperature indicator 11 is preferred because it has been customized for the preheating step, indicating only the temperatures relevant to the candleforming method. Moreover, color coded temperature designations 11*a* are easily observed even when submerged in water bath 47.

When water bath 47 has stabilized to a proper temperature, candle core 3 and heated water from water bath 47 are transferred into preheat container 5 and preheat container 5 is sealed. Then, preheat container 5 is submerged in water bath 47 for a duration of about 15 to 20 minutes. This method of preheating results in heat being distributed more completely and more uniformly throughout candle core 3. Consequently, more ideal sculpturing conditions results. However, preheat container 5 may be eliminated so that candle core 3 is directly submerged in water bath 47. Alternatively, only a portion or portions of candle core 3 designated as the working area may be submerged. After fifteen to twenty minutes in water bath 47, outer surface 29 of candle core 3 will be firm but softens when pressed. Additionally, because more heat is retained inside candle core 3, the surface temperature is maintained within the pliable temperature range for longer periods of sculpturing.

In a variation of the preheating method, sealed preheat container 5 is inserted between two coffee mugs (not shown) and then submerged in water bath 47. The mugs' weight keeps preheat container 5 and candle core 3 completely submerged in water bath 47, thereby insuring uniform heat distribution in candle core 3.

Candle core 3 is removed from preheat container 5 and transferred to a designated work place where sculpturing stand 7 is set up (see FIG. 4). Using wick loop 17, candle core 3 is suspended from suspension hook 7*d* on cross member 7*c*. Alternatively, candle core 3 may be stood upright on a table or cake decorating turntable. However, if candle core 3 is sculptured when it is placed on a surface, there is a risk that candle core 3 will bend from a downward force of a carve or cut. This risk is avoided by suspending candle core 3 from sculpturing stand 7, or even from a nail head (not shown) on a wall or a coat hanger (not shown). Another advantage to using sculpturing stand 7 is that candle core 3 may be easily observed and examined when suspended from suspension hook 7*d*.

Sculpturing stand 7 is built to accommodate a 4"–8" candle core 3 and for being set up on a kitchen table or other flat surface. Therefore, sculpturing stand 7 is very stable during the sculpturing process. Candle core 3 is easy to maneuver when suspended from sculpturing stand 7. While sculpturing, the candleformer may rotate candle core 3 about suspension hook 7*d* or tilt and move candle core 3 in any direction. Thus, the candleformer may cut, carve or form around candle core 3 without actually having to move around sculpturing stand 7.

To sculpture candle core 3, the candleformer merely follows the step-by-step guide in the instruction booklet 13 (FIG. 1) which corresponds to a selected candle design. The step-by-step guide outlines sculpturing techniques that may be performed by hand or by using a sculpturing tool such as a carving knife, a chisel, or some type of shaping device. On the other hand, the more experienced candleformer may wish to sculpture freestyle without the aid of instruction booklet 13 or according to some other candle design.

In many instances, it is necessary to reheat working areas on outer surface 29 of candle core 3 as the candleformer works around candle core 3. This is often the case when the sculpturing process is intricate and detailed. When a design requires extended curls or twists, for example, the candleformer might reheat the pieces of wax that are carved or gouged from the candle core 3 before curling or twisting the pieces of wax into place. By reheating the pieces, the candleformer obtains more satisfying results. At other times, candle core 3 simply cools and the work area has to be brought back to a pliable temperature.

Because candle core 3 is pliable at a relatively low temperature range, the reheating source may be provided by a readily available household heating element. Referring again to FIGS. 4 and 5, a preferable reheat source is a common 1500 watt hair dryer 55 with high and low settings. FIG. 5 depicts a reheating step being performed while candle core 3 is suspended from sculpturing stand 7 and with common hair dryer 55 as the reheating source. With relatively low heat output capacity, hair dryer 55 does not pose the safety risk that gas torches and other open flames do. Moreover, hair dryer 55 is easy to handle with one hand and can direct heat to localized areas on candle core 3 and away from finished or sculptured areas.

As depicted in FIG. 5, candle core 3 need not be removed from sculpturing stand 7 during the reheating step. In fact, it is preferable to reheat the working areas while candle core 3 is suspended from sculpturing stand 7. While retained in this position, candle core 3 may be rotated in either direction, tilted in any direction, moved backward, forward, and sideways. Thus, heat from hair dryer 55 may be directed to hard-to-access work areas without touching or possibly damaging the finished areas. Also, by moving both candle core 3 and hair dryer 55 relative to each other, it is easier to distribute heat over larger surface areas thereby guarding against overapplying heat to any one area on outer surface 29.

Figure 6:
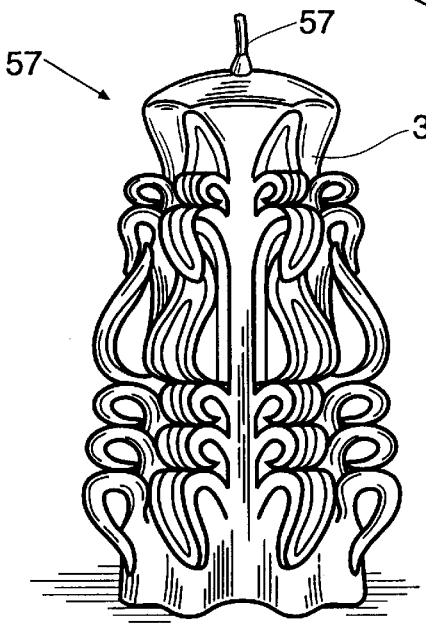
FIG. 6 depicts a finished decorative candle product formed using the candleforming method of the invention.

FIG. 6 is an example of a finished decorative candle product 57 formed using the candleforming method of the invention. After the sculpturing process, decorative candle 57 may be maintained in the suspended position on sculpturing stand 7 and allowed to cool. Thereafter, wick 17 is trimmed off and decorative candle 57 is ready for display.

FIG. 7 depicts a ribbon candle 35 featuring six separate columns 59 of petals 61 and a twist 63 between each column 59. Instruction booklet 13 provides step-by-step instructions on forming ribbon candle 35 in accordance with the candleforming method. After preheating candle core 3, candle core 3 is placed adjacent to a scale 31 found in instruction booklet 13. Then, using a non-serrated kitchen knife (not shown), a flute 3*b* of candle core 3 is marked according to hash mark indications 33 on scale 31. After finishing one flute 3*b*, an adjacent flute 3*b* is marked in the same manner until all six of flutes 3*b* are marked. Beginning at each mark, a non-serrated knife is used to carve down and into candle core 3 thereby exposing a wedged piece of carved wax. To form a petal 61, the exposed wax is pulled back or curled using only the fingers of the hand. After finishing one column 59, hair dryer 55 is used to reheat the next flute 3*b* to be carved and curled.

To form twist 63, gouge tool 9 (FIG. 1) is first positioned near top end 3*c* of candle core 3 between petal columns 59 with leading tip section 9*c* (FIG. 1) angled against surface 29 of candle core 3. Using tip section 9*c* to penetrate surface 29, a ⅛" deep cut is made. Then, with tip section 9*c* still beneath surface 29 of flute 3*b*, a ⅛" groove is cut all the way down flute 3*b* until just before base 3*a* thereby exposing a loose, elongated piece of wax. After slipping gouge tool 9 off the elongated piece, heat is applied with hair dryer 55 to re-soften it. Then, the elongated piece is twisted several times using two fingers and replanted in the groove. FIG. 7 depicts the finished product 35.

Figure 8:
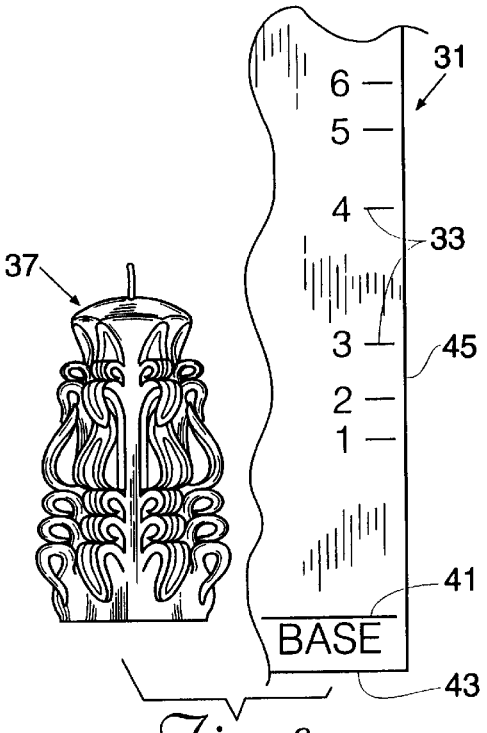
FIG. 8 depicts a pop-out ribbon candle placed adjacent to a scale with hash marks according to the invention.
Figure 9:
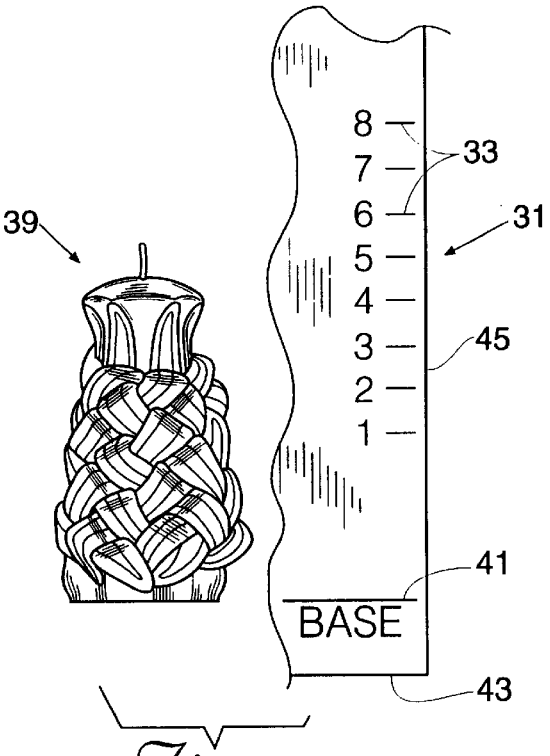
FIG. 9 depicts a decorative candle product bearing a basket weave design, the candle product being placed adjacent to a scale with hash marks according to the invention.

FIGS. 8 and 9 depict two more decorative candles 37, 39 that can be formed using the candleforming method of the invention. FIG. 8 depicts a pop out ribbon candle 37 that is formed using curling, carving, and gouge cuts. FIG. 9 depicts a basket weave candle 39 that is formed using basic curling and carving techniques.

Figure 10:
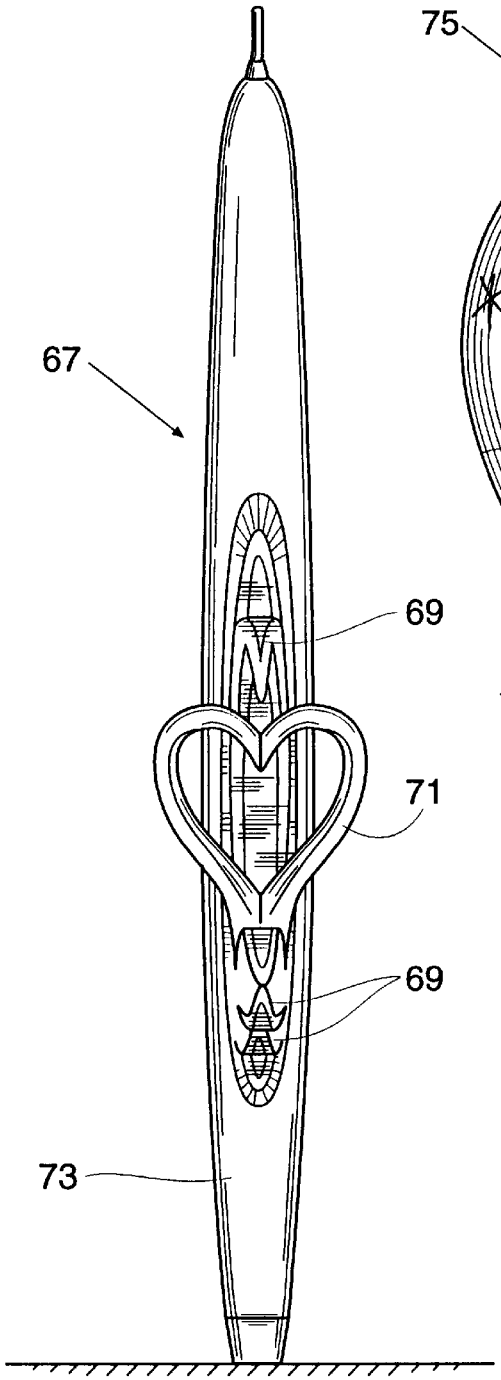
FIG. 10 depicts a finished decorative candle formed from an elongated candle core and with a sculptured portion that was removed from a second candle core deposited on its outer surface.

FIG. 10 depicts yet another decorative candle product 67 formed using a candleforming method according to the present invention. The design of decorative candle 67 includes several carved petals 69 and a unique heart-shaped wax piece 71. In the candleforming method associated with decorative candle 67, two candle cores may be used. A first candle core (not shown) is utilized as a source candle and a second candle core 73 functions as a base or receiving candle. Candle core 73 in FIG. 10 has a tall, elongated shape rather than the short, tapered proportions of previously described candle cores 3. The source candle core may be one of candle cores 3 depicted in FIG. 1 or it may have a different shape and/or composition. Also, it may or may not have a plurality of color layers.

According to this candleforming method, portions of the source candle core may be sculptured as described previously. The sculptured portions (not shown) are then removed from the source candle core and deposited on base candle core 73. To affix the sculptured portions, hair dryer 55 is used to re-soften the area of contact between the sculptured portions and base candle core 73. Then, the contact area is allowed to cool thereby solidifying the sculptured portion on base candle core 73. In FIG. 10, heart-shaped piece 71 was sculptured on the source candle and then deposited on base candle core 73. Carved petals 69 were formed according to the candleforming method described previously.

Alternatively, the portions that are removed from the source candle core do not have to be sculptured before being applied to the base candle. The removed portion are simply removed from the source candle core by some conventional means and then applied to the base candle core where it is then sculptured. In this way, the removed portions may be easier to apply to the base candle.

It should also be noted that the source candle core and/or the base candle core may or may not be layered as previously described. Thus, a finished candle produced by the candleforming method according to the invention may be non-layered and have the same color throughout.

Figure 11:
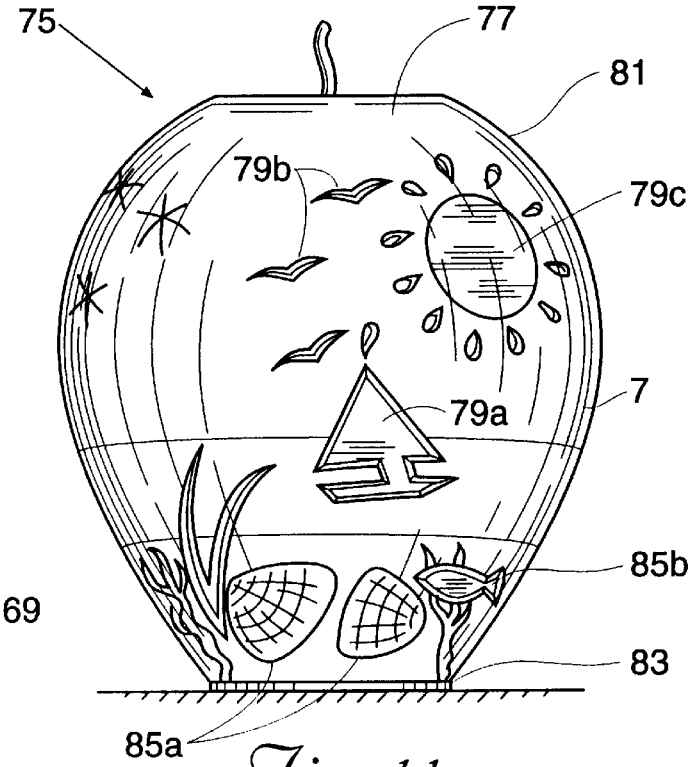
FIG. 11 depicts a finished decorative candle product formed from a candle core, the candle core having distinct decorative items affixed to its outer surface and additional designs carved on its outer surface.

FIG. 11 depicts yet another decorative candle product 75 formed using a method according to the present invention. Decorative candle 75 was formed from an oval-shaped candle core 77 having multiple surface colors. A plurality of distinct designs 79*a*, 79*b*, and 79*c* has been carved onto its outer surface 81 including a sailboat 79*a*, seagulls 79*b*, and a sun 79*c*. To carve these designs 79*a* through 79*c*, instruction booklet 13 provides a design template (not shown) bearing the outlines of designs 79*a* through 79*c*. Candle core 77 is preheated to bring the temperature of outer surface 81 to the pliable temperature range. Then, candle core 77 is placed in a sculpturing position. Candle core 77 of FIG. 11 is provided with a heat insulating base 83 for supporting candle core 77 during the sculpturing steps. Alternatively, candle core 77 may be suspended from sculpturing stand 7 or equivalent. After candle core 77 is placed in position, the template is removed from instruction booklet 13 and placed adjacent to outer surface 81. A sculpturing implement (not shown) such as a paring knife or equivalent may then be used to carve out the design on the template. As necessary, outer surface 81 may be reheated using hair dryer 55 or another common heating element.

Candleforming kit 1 (FIG. 1) may also include distinct decorative items 85*a*, 85*b* (FIG. 11) which may be embedded onto outer surface 81 of candle core 77. Referring again to FIG. 11, decorative candle product 75 has embedded onto its outer surface 81 a pair of clamshells 85*a* and a ceramic fish design 85*b*. These decorative items 85*a*, 85*b* are provided with candleforming kit 1. Following instruction booklet 13, decorative items 85*a*, 85*b* may be planted on outer surface 77 of candle core 77 with a pair of tweezers (not shown) and hair dryer 55. In FIG. 11, decorative candle product 75 portrays a marine environment including a sailboat 79*a* on blue water, seagulls 79*b* and a sun 79*c* in the sky, and clamshells 85*a* and a fish 85*b* under water. Of course, other scenes may be depicted, and other types of items may be imbedded on outer surface 77.

While several embodiments of the present invention have been shown and described, alternate embodiments will be apparent to those skilled in the art and are within the intended scope of the present invention. Therefore, the invention is to be limited only by the following claims.

I claim:

1. A method for forming decorative candles, comprising the steps of:

providing a candleforming kit that includes a candle core having a composition such that an outer surface of said candle core melts at a temperature below about 150° Fahrenheit;

heating a working area on an outer surface of said candle core such that said working area is pliable;

sculpturing a portion of said working area;

reheating said portion of said working area with a readily available household heating implement whenever the temperature of said portion of said working area falls below a predetermined temperature; and continuing to sculpture said portion of said working area after said reheating step.

2. The method of claim 1, wherein the reheating step includes the step of reheating said portion of said working area with a hair dryer.

3. The method of claim 1, wherein the step of providing a candleforming kit includes the step of:

providing a candle core having a composition such that said outer surface of said candle core is pliable at a temperature below about 130° Fahrenheit.

4. The method of claim 1, wherein the step of providing a candleforming kit includes the step of:

providing a candle core having a plurality of layers, each of said layers having a distinct composition.

5. The method of claim 1, further comprising the steps of:

providing a container suitable for containing a volume of heated water;

placing heated water in said container to make a water bath having a temperature similar to a temperature at which said outer surface of said candle core is pliable;

wherein said heating step includes the step of submerging at least said working area of said candle core in said water bath for a duration such that said working area of said candle core becomes pliable; and removing said working area from said water bath.

6. The method of claim 5, further comprising the step of:

providing a temperature indicator for indicating the temperature of said water bath; and wherein said heating step includes using said temperature indicator to monitor the temperature of said water bath during the step of placing heated water in said container.

7. The method of claim 5, wherein the heating step further includes the steps of:

providing a closable container;

transferring a volume of said heated water into said closable container, said volume of said heated water having a temperature similar to a temperature at which said outer surface of said working area is pliable;

inserting said candle core into said closable container;

closing said closable container; and wherein said submerging step includes submerging said closable container.

8. The method of claim 1, wherein said step of providing a candleforming kit includes providing a guide for sculpturing said candle core, said guide including a design pattern, the method further comprising the step of:

placing said design pattern adjacent to said working area before the sculpturing step; and wherein said sculpturing step includes using said guide to sculpture said design pattern on said working area.

9. The method of claim 1, wherein said step of providing a candleforming kit includes providing a sculpturing implement and a guide for sculpturing a design on said candle core, said guide including a scale, said method further comprising the steps of:

placing said scale adjacent to said outer surface of said candle core; and using said scale to position said sculpturing implement on said working area, before said sculpturing step.

10. The method of claim 1, wherein said step of providing a candleforming kit includes the step of providing a candle core having a wick with a loop, said method further comprising the step of:

placing said candle core in a position for sculpturing by suspending said candle core by said wick loop, after the heating step.

11. The method of claim 10, wherein said step of providing a candleforming kit includes:

providing a sculpturing stand having an elevated suspending implement; and wherein said step of placing said candle core in a sculpturing position includes engaging said wick loop with said suspending implement.

12. The method of claim 10, wherein said reheating step includes reheating said portion of said outer surface of said candle core while said candle core is in said sculpturing position.

13. The method of claim 1, wherein said step of providing a candleforming kit includes providing a second candle core, said method further comprising the steps of:

removing a portion of said second candle core; and wherein the sculpturing step includes the step of affixing said portion from said second candle core onto said working area of said second candle core.

14. The method of claim 13, further comprising the step of:

sculpturing a portion of a working area on an outer surface of said candle core; and wherein said removing step includes the step of removing said sculptured portion of said working area of said second candle core.

15. The method of claim 1 further comprising:

providing a decorative item that is distinct from said candle core; and wherein the sculpturing step includes the step of depositing said decorative item onto said working area.

16. The method of claim 15, wherein the step of depositing said decorative item includes the step of applying heat to said working area with a readily available heating implement.

* * * * *